US011489282B2

(12) United States Patent
Lopez

(10) Patent No.: US 11,489,282 B2
(45) Date of Patent: Nov. 1, 2022

(54) DISMOUNTABLE ELECTRICAL CONNECTION MODULE

(71) Applicant: Amphenol - Air LB, Carignan (FR)

(72) Inventor: Christophe Lopez, Haraucourt (FR)

(73) Assignee: AMPHENOL - AIR LB, Carignan (FR)

( * ) Notice: Subject to any disclaimer, the term of this patent is extended or adjusted under 35 U.S.C. 154(b) by 0 days.

(21) Appl. No.: 17/019,048

(22) Filed: Sep. 11, 2020

(65) Prior Publication Data

US 2021/0273369 A1 Sep. 2, 2021

(30) Foreign Application Priority Data

Feb. 28, 2020 (FR) ..... 2001990

(51) Int. Cl.
*H01R 13/506* (2006.01)
*H01R 13/24* (2006.01)

(52) U.S. Cl.
CPC ..... *H01R 13/506* (2013.01); *H01R 13/2421* (2013.01)

(58) Field of Classification Search
CPC .. H01R 13/506; H01R 13/2421; H01R 13/11; H01R 13/15
See application file for complete search history.

(56) References Cited

U.S. PATENT DOCUMENTS 3,456,231 A * 7/1969 Zimmerman, Jr. et al. ..... H01R 13/20 439/532
3,597,726 A * 8/1971 Appleton ..... H01R 13/5221 439/724
4,854,899 A * 8/1989 Matthews ..... H01R 31/02 439/724
5,192,233 A 3/1993 Suffredini et al.
5,356,316 A * 10/1994 Anderson ..... H01R 9/2408 439/97

FOREIGN PATENT DOCUMENTS

FR 0265339 A1 4/1988

OTHER PUBLICATIONS

Preliminary Search Report dated Oct. 22, 2020, issued in corresponding French Application No. 2001990, filed Feb. 28, 2020, 9 pages.

* cited by examiner

*Primary Examiner* — Briggitte R. Hammond
(74) *Attorney, Agent, or Firm* — Christensen O'Connor Johnson Kindness PLLC

(57) ABSTRACT

This module for electrically connecting conductors comprises an electrically insulating body comprising means for removably fastening the body in a cavity of a sub-mount and means for mechanically fastening and electrically connecting conductors. It includes, for each conductor, an electrically conductive insert inserted into the body and comprising releasable means for mechanically fastening and electrically connecting the conductors and in that the electrical connection tabs of the module are secured to the insert.

5 Claims, 4 Drawing Sheets

[Fig 1]
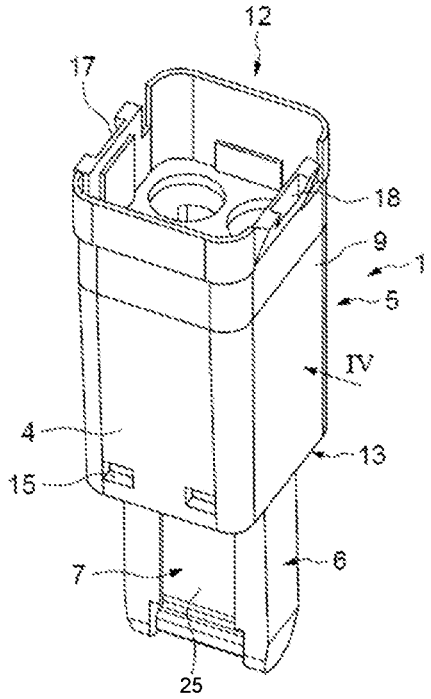
[Fig 2]
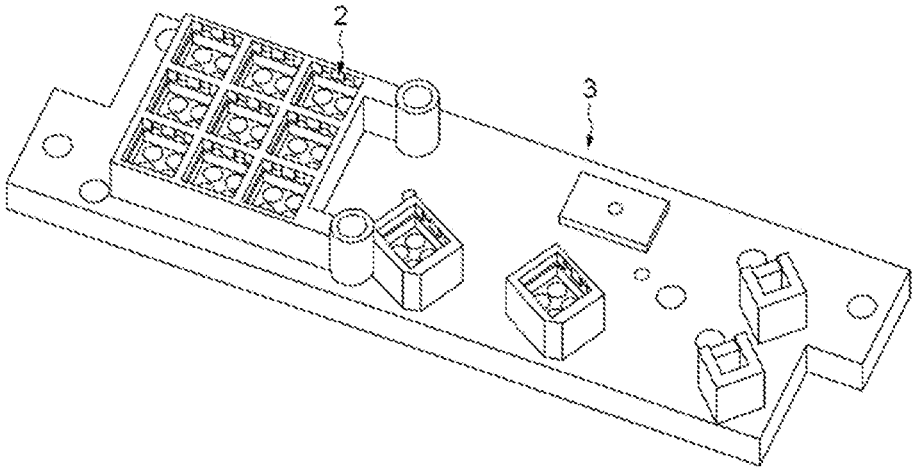

[Fig 3]
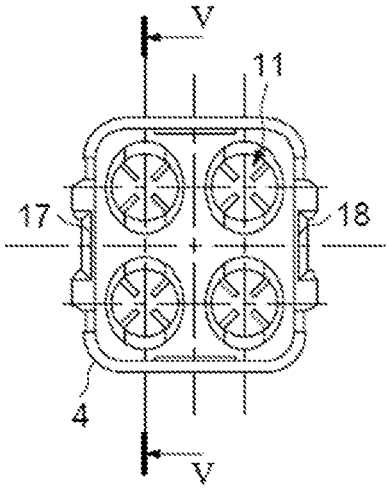

[Fig 4]
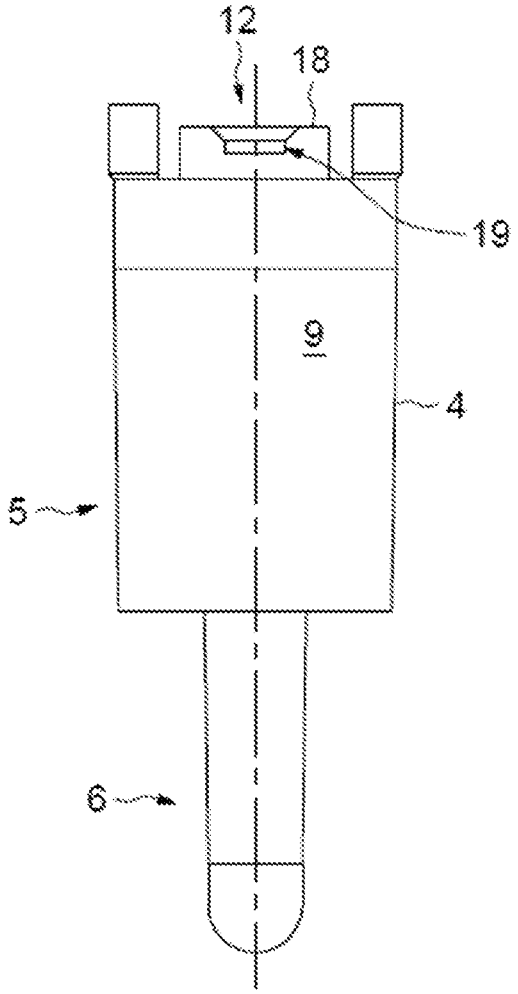

[Fig 5]
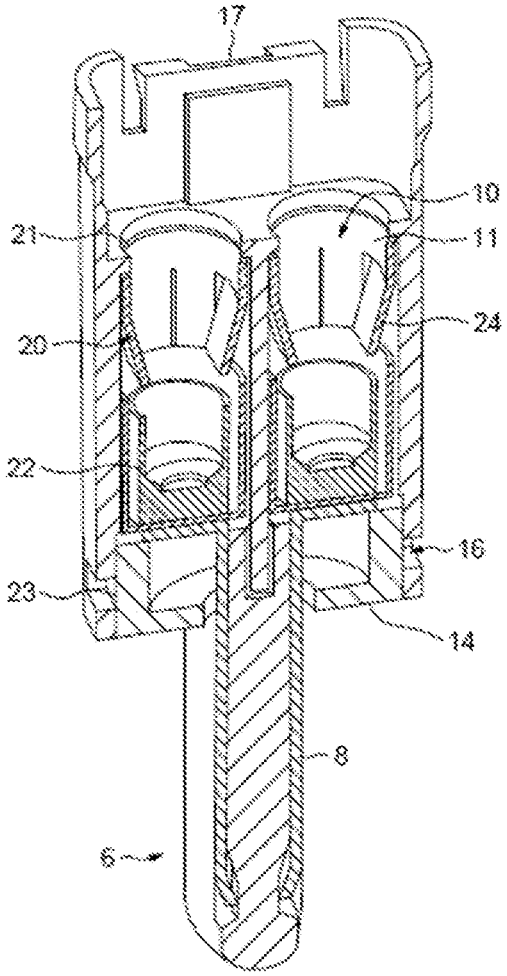

DISMOUNTABLE ELECTRICAL CONNECTION MODULE

CROSS-REFERENCE TO RELATED APPLICATION

This application claims the benefit of French Application No. 2001990, filed Feb. 28, 2020, the disclosure of which is expressly incorporated herein by reference in their entirety.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The purpose of the disclosure is to overcome the disadvantages of electrical connection modules of the types used in the prior art, and to provide an electrical connection module of conductors which is mounted on a sub-mount, which can be dismounted from the sub-mount and which furthermore allows disconnection of the conductors, without risk of damage to the module or the contacts.

The object of the disclosure is therefore a module for electrically connecting conductors, comprising an electrically insulating body comprising means for removably fastening the body in a cavity of a sub-mount and means for mechanically fastening and electrically connecting conductors.

This connection module includes, for each conductor, an electrically conductive insert disposed in the body, comprising releasable means for mechanically fastening and electrically connecting the conductors, the electrical connection tabs of the module being secured to the insert.

Thus, thanks to the means for removably fastening the body in a cavity of the sub-mount, and to the releasable means for mechanically fastening and electrically connecting the conductors, the body can be separated from the sub-mount and the conductors can be disconnected from the insert.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein:

FIG. 1 is a perspective view of an electrical connection module in accordance with the disclosure;

FIG. 2 is a perspective view of a sub-mount into which a set of connection modules of FIG. 1 snap;

FIG. 3 is a top view of the module of FIG. 1;

FIG. 4 is a side view in direction IV of FIG. 1; and

FIG. 5 is a sectional view along line V-V of the electrical connection module of FIG. 3.

DETAILED DESCRIPTION

The present disclosure relates to electrical connection modules, in particular electrical connection modules intended for use in on-board networks of transport vehicles, in particular but not exclusively in the railway field, for the electrical connection of conductors to be connected.

Conventionally, such a module includes a body, made of an electrically insulating material, for example of a plastic material, wherein an electrical connection lug is mounted on which are fastened, by crimping, contacts provided at the ends of the conductors to be connected.

According to the applications and according to the use, the connection lug can be provided to receive several male contacts and to be plugged into a corresponding connector in order to ensure the simultaneous connection of the conductors connected to the electrical connection lug.

It has been found that modules of this type are not dismountable, in that they do not allow the conductors to be disconnected without having to cut them. Nor can modules of this type be unplugged without causing damage or even destruction of the body.

The purpose of the disclosure is therefore to overcome the disadvantages of electrical connection modules of the aforementioned type, and to propose an electrical connection module of conductors which is mounted on a sub-mount, which can be dismounted from the sub-mount and which furthermore allows disconnection of the conductors, without risk of damage to the module or the contacts.

The object of the disclosure is therefore a module for electrically connecting conductors, comprising an electrically insulating body comprising means for removably fastening the body in a cavity of a sub-mount and means for mechanically fastening and electrically connecting conductors.

This connection module includes, for each conductor, an electrically conductive insert disposed in the body, comprising releasable means for mechanically fastening and electrically connecting the conductors, the electrical connection tabs of the module being secured to the insert.

Thus, thanks to the means for removably fastening the body in a cavity of the sub-mount, and to the releasable means for mechanically fastening and electrically connecting the conductors, the body can be separated from the sub-mount and the conductors can be disconnected from the insert.

Furthermore, the insert can be separated from the module body.

According to another feature, the insert includes two locking springs comprising a set of elastically deformable lugs in each of which snaps a male contact provided at one end of the conductor, two sockets each receiving said male contact and a blade.

For example, each socket includes a set of radially deformable elastic angular sectors when the contact is inserted.

In one embodiment, the sockets are made of copper alloy, in particular copper-beryllium, or brass.

The insert can also be made of copper alloy, in particular copper-beryllium, or brass.

In one embodiment, the body includes an end area comprising a set of snap-fitting ramps intended to cooperate with complementary snap-fitting means provided in the cavity of the sub-mount.

For example, the module includes an axial tail for radially holding the tabs.

Other purposes, features and advantages of the invention will appear upon reading the following description, given only by way of non-limiting example, and made with reference to the appended drawings wherein:

FIG. 1 is a perspective view of an electrical connection module in accordance with the invention;

FIG. 2 is a perspective view of a sub-mount into which a set of connection modules of FIG. 1 snap;

FIG. 3 is a top view of the module of FIG. 1;

FIG. 4 is a side view in direction IV of FIG. 1; and

FIG. 5 is a sectional view along line V-V of the electrical connection module of FIG. 3.

First, reference is made to FIGS. 1 and 2 which respectively illustrate a perspective view of an electrical connection module in accordance with the disclosure and a sub-mount intended to receive a set of such modules, here eleven in number.

Each module, designated by the general reference numeral 1, is intended to receive a set of conductors here four in number and is intended to be mounted, in particular by snap-fitting, in a through cavity 2 of the sub-mount 3.

Advantageously, the connector 2 is a connector with tabs, these tabs being accessible from the other side of the sub-mount to form a plug capable of engaging in a corresponding female contact.

Each connector 1 includes a body 4 made of insulating material, for example of a molded plastic material, comprising a portion 5 of parallelepiped section, here rectangular section, and an axial end tail 6 extending from the body 4.

The axial tail 6 is provided with two longitudinal grooves 7 each ensuring the holding of an electrical connection tab 25.

The axial tail 6 is indeed intended to pass through the sub-mount 3 in order to be accessible from the opposite side of the cavities 2.

The first portion 5 includes four side walls, such as 9, which are parallel in pairs and, internally, for each conductor, a cylindrical through passage 10 wherein is housed an insert 11. In the illustrated embodiment, each connector is provided with four cylindrical passages to ensure the electrical connection of four conductors. Of course, the number of connectors that can be connected simultaneously is in no way limiting and can be adapted by adapting the number of inserts in the connector body accordingly.

The first portion 5 of the connector body includes an open proximal end 12 through which the conductors to be connected are inserted into the connector and an opposite distal end 13 closed by the axial tail 6. The tail 6 indeed includes a base 14 provided with snap-fitting teeth 15 engaging laterally in corresponding orifices 16 formed in respective walls facing the connector body 4.

On the proximal side, the end of the connector body is provided with two elastically deformable snap-fitting lugs 17 and 18 each provided with a snap-fitting ramp 19 engaging in a corresponding indentation formed in the cavity 2 of the sub-mount 3.

As can be seen in FIG. 5, each insert 11 is held in a cylindrical passage 10 of the connector body by means of an annular narrowing 21 provided at the proximal end of the cylindrical passage, this annular narrowing constituting a stop preventing any accidental pullout of the insert.

Each insert is made of an elastically deformable electrically conductive material. In particular, a material will be selected having good electrical conduction properties and elastic deformation properties allowing effective holding of the conductors and effective holding of the insert in the cavity while making the conductors and the insert removable.

Advantageously, a copper-based alloy, preferably an alloy mainly comprising copper or copper alloy, in particular copper-beryllium or brass will be selected.

Each insert includes on the one hand two locking springs 20 ensuring the mechanical fastening and the electrical connection of a connector provided at one conductor end to be connected, two attached elastic sockets 22 inserted into the locking spring 20 and a common blade 8.

Each locking spring 20 extends along the height of the cylindrical passage 10 and bears, by its proximal end, against the internal annular narrowing 21 of the connector body. It is provided with a number of axial slots facilitating the deformation of the locking spring.

The insert comprising the two locking springs, the two sockets and the common blade 8, bears against the base 14 which snaps into the body thanks to the teeth 15 which snap into the orifices 16.

The socket 22 is shaped to receive the end connector of the conductor. It is also split to improve its elastic deformation to ensure holding and good electrical contact with the connector.

Finally, each locking spring 20 is provided with elastically deformable lugs, such as 24, for example two in number, produced by cutting the peripheral wall of the locking spring.

These lugs 24 extend in a radially internal direction to constitute a stop for the connector provided at the end of the conductor to be connected. They are deformable enough to fold down when the connector is inserted and when the connector is dismounted.

The disconnection of the conductors is also carried out by means of an appropriate tool capable of folding down the elastically deformable lugs 24.

Finally, the connector 1 can be dismounted from the cavities 2 of the sub-mount 3 using a tool.

The disclosure therefore allows to produce a dismountable connector which can be dismounted from the sub-mount, which allows to dismount the insert and which allows to disconnect the previously connected conductors.

These dismounting operations can be carried out, for example, during maintenance operations, for example in the event of a malfunction of the insert or when a wiring fault has been observed.

While illustrative embodiments have been illustrated and described, it will be appreciated that various changes can be made therein without departing from the spirit and scope of the invention.

The embodiments of the invention in which an exclusive property or privilege is claimed are defined as follows:

1. A module for electrically connecting conductors, comprising an electrically insulating body (4) comprising two elastically deformable snap-fitting lugs (17, 18) each provided with a snap-fitting ramp (19) for removably fastening the body in a cavity (2) of a sub-mount (3) characterized in that the module includes, for each conductor, an electrically conductive insert (11) disposed in the body and comprising two lock springs (20) comprising a set of elastically deformable lugs (24) for mechanically fastening and electrically connecting the conductors and one or more electrical connection tabs (25) of the module secured to the insert, the module comprising an axial tail (6) for radially holding the one or more electrical connection tabs (25).

2. The module according to claim 1, wherein a contact is provided at one end of the conductor snapping in each of the lugs (24) of the locking springs (20), and the insert comprises two sockets each receiving a male contact and a blade (8).

3. The module according to claim 2, wherein the socket is made of copper alloy.

4. The module according to claim 1, wherein the insert is made of copper alloy.

5. The module according to any one of claim 1, wherein the body (4) includes an end area comprising the snap-fitting ramps (19) intended to cooperate with complementary snap-fitting means provided in the cavity (2) of the sub-mount (3).

* * * * *